US007990273B2

(12) United States Patent
Handyside et al.

(10) Patent No.: US 7,990,273 B2
(45) Date of Patent: Aug. 2, 2011

(54) INVENTORY ALARM AND INK TAG COMBINATION

(76) Inventors: Graham Handyside, San Jose, CA (US); Xiao Hui Yang, Cupertino, CA (US)

( * ) Notice: Subject to any disclaimer, the term of this patent is extended or adjusted under 35 U.S.C. 154(b) by 345 days.

(21) Appl. No.: 12/157,758

(22) Filed: Jun. 13, 2008

(65) Prior Publication Data

US 2009/0058659 A1 Mar. 5, 2009

Related U.S. Application Data

(60) Provisional application No. 60/934,378, filed on Jun. 13, 2007.

(51) Int. Cl.
*G08B 13/14* (2006.01)

(52) U.S. Cl. ..... 340/572.9; 340/568.1; 340/506

(58) Field of Classification Search ..... 340/572.9, 340/541, 551, 572.1–572.8, 568.1, 506
See application file for complete search history.

(56) References Cited

U.S. PATENT DOCUMENTS

| | | | | |
|---|---|---|---|---|
| 6,631,629 | B1 * | 10/2003 | Fuss et al. | 70/57.1 |
| D569,288 | S * | 5/2008 | Raymond | D10/104 |
| 7,652,574 | B2 * | 1/2010 | Sayegh | 340/568.1 |
| 2004/0222890 | A1 * | 11/2004 | Yang et al. | 340/572.9 |

* cited by examiner

*Primary Examiner* — Daniel Previl
(74) *Attorney, Agent, or Firm* — Colin P. Abrahams

(57) ABSTRACT

An inventory control tag comprises a first component, a second component, and a fastening mechanism for fastening together the first component and the second component. The fastening mechanism is configured such that the first component and the second component can be easily locked together and can only be unlocked from each other in normal usage by an external tool. At least one chamber defined by at least one of the first and second components is provided. Further, an electronic device is located in one of the chambers for triggering a compatible sensor and alarm system external to the control tag. A dye container located in one of the chambers designed to fracture and spill dye when the first and second components are forced apart.

20 Claims, 2 Drawing Sheets

INVENTORY ALARM AND INK TAG COMBINATION

CROSS REFERENCE TO RELATED APPLICATIONS

This application claims the benefit of U.S. Provisional Patent Application No. 60/934,378 filed Jun. 13, 2007, and which is incorporated herein by reference in its entirety.

FIELD AND BACKGROUND OF THE INVENTION

This invention relates to product and inventory control tags which trigger an alarm when in an environment where its presence can be detected. The control tags also preferably comprise an ink reservoir which will be fractured or otherwise affected so as release ink therefrom if the article upon which it is mounted is tampered with in that an unauthorized person attempts to remove the tag from the article to which it is attached.

SUMMARY OF THE INVENTION

According to one aspect of the invention, there is provided an inventory control tag comprising: a first component; a second component; a fastening mechanism for fastening together the first component and the second component, the fastening mechanism being configured such that the first component and the second component can be easily locked together and can only be unlocked from each other in normal usage by an external tool; at least one chamber defined by at least one of the first and second components; an electronic device located in one of the chambers for triggering a compatible sensor and alarm system external to the control tag; and a dye container located in one of the chambers designed to fracture and spill dye when the first and second components are forced apart.

Preferably, the fastening mechanism comprises a pin assembly formed on the first component, the pin assembly having a support head and a pin shaft. The fastening mechanism may further comprise a clutch mechanism formed on the second component, the clutch mechanism being configured to receive the pin shaft of the pin assembly when the first and second components are fastened together. In one form, the clutch mechanism comprises a three ball clutch which is located in a cup shaped member of the second component.

Preferably, the dye container is formed in the support head of the pin assembly, and the electronic device is located in the chamber of the second component. In one embodiment, the dye container is formed as recess in the support head of the pin assembly. The recess in the support head may comprise a reservoir plug in an aperture in the recess which fractures or is compromised when the first and second components are forced apart to discharge the dye from the recess.

In one aspect of the invention, the dye container comprises at least one frangible receptacle located in the chamber of the first component, the frangible component fracturing in response to forcing the first and second components apart from each other.

Preferably, the first component has an access cap for providing access to the chamber in the first component.

The first and second components may form a generally flattened control tag when fastened together by the fastening mechanism, may form a generally circular control tag when fastened together by the fastening mechanism, may form a generally oval control tag when fastened together by the fastening mechanism, or be of any convenient shape.

Preferably, the dye container contains ink, and may comprise at least two ink containers.

According to another aspect of the invention, there is provided a method for controlling inventory comprising the steps of: providing a first control tag component; providing a second control tag component; fastening together the first control tag component and the second control tag component such that the first control tag component and the second control tag component can be easily locked together and can only be unlocked from each other in normal usage by an external tool; forming at least one chamber in at least one of the first and second control tag components; inserting an electronic device in one of the chambers for triggering a compatible sensor and alarm system external to the control tag; and inserting a dye container in one of the chambers, the dye container being designed to fracture and spill dye when the first and second control tag components are forced apart from each other.

Preferably, the first control tag component is fastened to the second control tag component by a pin and clutch mechanism.

The dye container may be inserted in the chamber of the first control tag component and the electronic device is inserted in the chamber of the second control tag component. Further, the first and second control tag components may be shaped so as to have a desired external configuration suitable for attachment to a selected product.

According to another aspect of the invention, there is provided a method for making a control tag for controlling inventory, the method comprising the steps of: providing a first control tag component; providing a second control tag component; fastening together the first control tag component and the second control tag component such that the first control tag component and the second control tag component can be easily locked together and can only be unlocked from each other in normal usage by an external tool; forming at least one chamber in at least one of the first and second control tag components; inserting an electronic device in one of the chambers for triggering a compatible sensor and alarm system external to the control tag; and inserting a dye container in one of the chambers, the dye container being designed to fracture and spill dye when the first and second control tag components are forced apart from each other.

DETAILED DESCRIPTION OF THE INVENTION

Reference is made to the accompanying drawings which show a control tag in accordance with the invention, both in complete views and as exploded views of the invention. The exploded views of the invention show the internal components and operation of the control tag and its structural characteristics which facilitate appropriate engagement and disengagement of the upper and lower parts.

The micro shell alarming ink tag is designed to provide multiple anti-theft measures in a single unit, preferably including both ink and alarm protection. The control tag of the invention incorporates and is based upon the standard 3-ball clutch mechanism structure and preferably includes a 58 Khz and/or 8.2 Mhz ferrite member. The tag ferrite will be energized by an electronic article surveillance (EAS) system that preferably generates a 58 Khz or 8.2 Mhz magnetic field respectively, and subsequently generate its own 58 Khz or 8.2 Mhz signal that will be detected by EAS detection systems. An alarm will thus be activated when the product to which the control tag is attached passes through an EAS detector arrangement.

In addition, tampering with the control tag or attempting to remove it from the article to which it is attached will cause a sealed ink reservoir contained within the tag to break or fracture, thereby releasing the ink within. The result is the permanent staining the article with the released ink. At the same time, the article is branded with a clear visible marking so that it is immediately recognizable as one which may have been stolen or unlawfully obtained. Furthermore, the released ink from the reservoir may also have the consequence of effectively ruining the article, such as an electronic device or an item of clothing, so that the article becomes worthless to the person trying to steal it.

Figure 1:
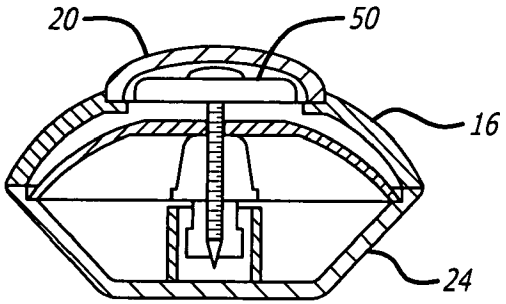
FIG. 1 is a front view of a micro shell alarm and ink tag in accordance with one aspect of the invention.
Figure 2:
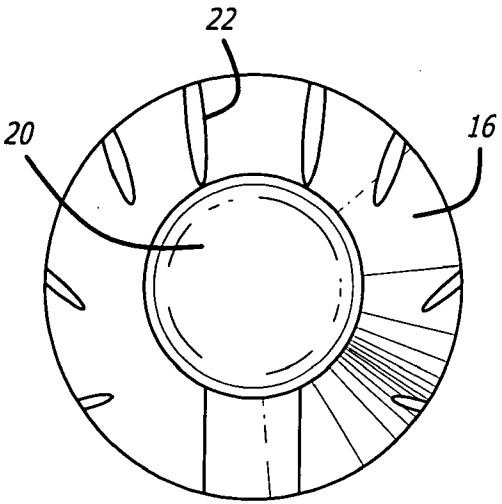
FIG. 2 is a top view of the micro shell alarm and ink tag as shown in FIG. 1 of the drawings.
Figure 3:
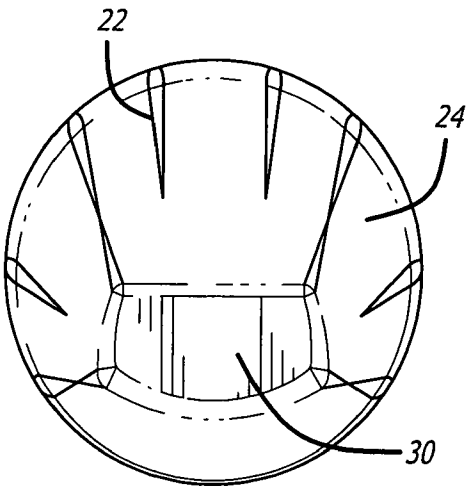
FIG. 3 is a bottom view of the micro shell alarm and ink tag as shown in FIG. 1 of the drawings.
Figure 4:
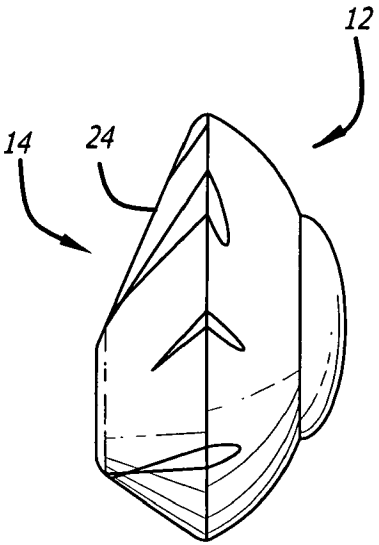
FIG. 4 is a side view of the micro shell alarm and ink tag as shown in FIG. 1 of the drawings.
Figure 5:
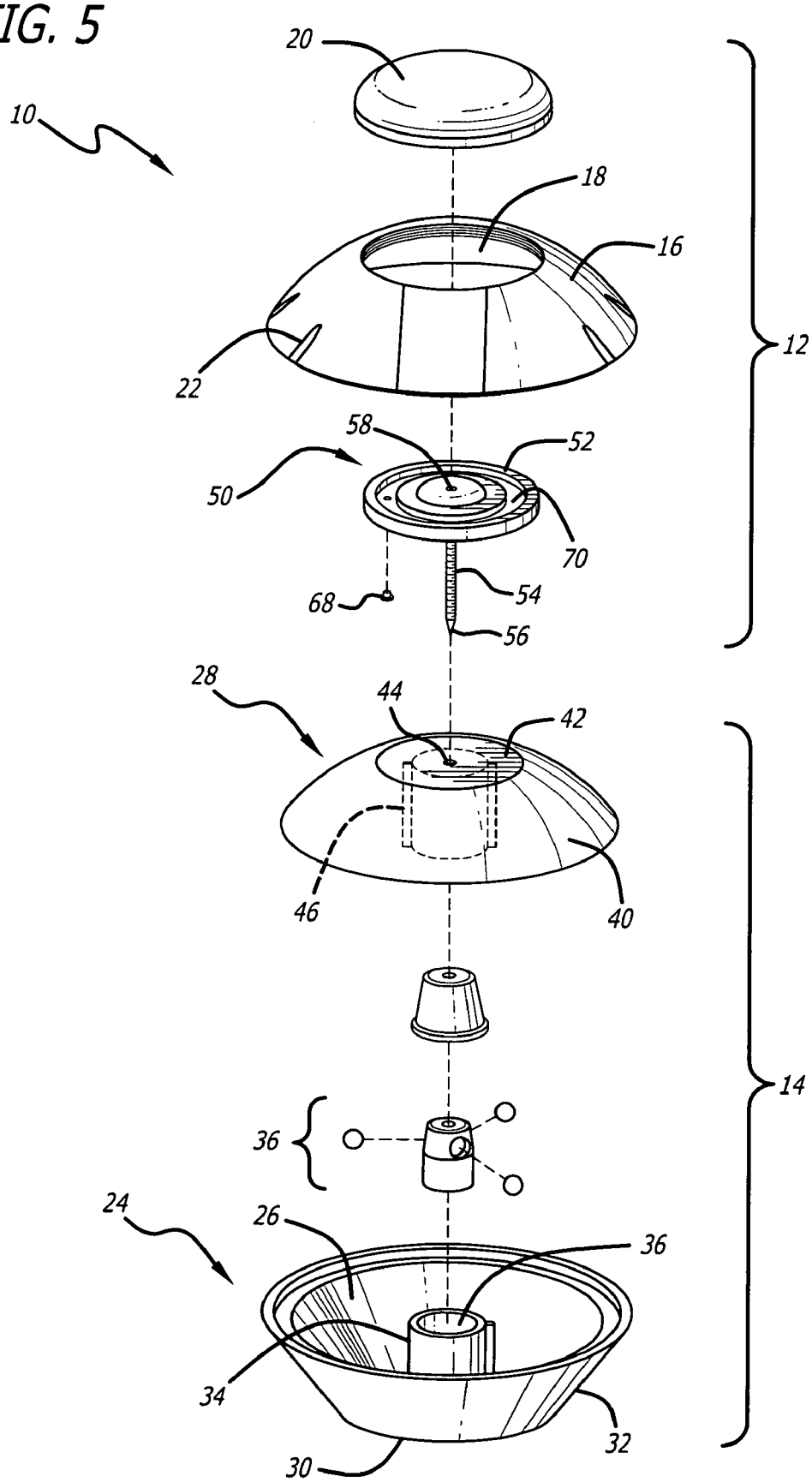
FIG. 5 is an exploded view of the micro shell alarm and ink tag in accordance with the invention showing its constituent components and assembly.

As will be seen from the drawings, and best illustrated in FIG. 5 of the drawings, the control tag 10 is comprised of an upper half shell assembly 12 and a lower half shell assembly 14. The upper half shell assembly 12 of the control tag 10 has a top shell cap 16 which is generally dome shaped and has a central opening 18 which receives a reservoir protection cap 20. The outer surface of the top shell cap 16 may have ribs 22 to facilitate improved grip capacity when held by a user.

The lower half shell assembly 14 comprises a base member 24 which defines an open chamber 26 and a cover 28 which fits over the base member 24 so as to close the chamber 26. A suitable form of connection between the base member 24 and the cover 28 along their respective common circumferences is provided to ensure a positive seal there between.

The base member 24 has a base wall 30 and a side wall 32. Formed on the base wall 30 is generally cylindrical cup 34 which is hollow and has an opening 36. The cup 34 receives a three ball clutch 36 of generally known construction in the art, the clutch being designed to receive and hold a pin by the pressure of the balls thereon. The pin, to be briefly described below, can be removed from the clutch 36 when the balls are appropriately subjected to the forces of a magnet strong enough to move the balls off the pin, thereby disengaging the pin and allowing for the release thereof from the control tag 10.

The cover 28 has a generally dome shaped portion 40 and a flat top 42, the flat top 42 having a substantially centered hole 44 through which the pin shaft passes in order to engage the clutch 36. The inner surface of the cover 28 has one or more projections 46 which cooperate with the cup 34 so that the clutch 36 can be held in place when the cover 28 is mounted on the base member 24.

A pin assembly 50 is provided. The pin assembly 50 comprises a support head 52 and a pin shaft 54. The pin shaft 54 itself has a pointed end 56 and a connected end 58 where is it permanently fastened to the support head 52. It will be seen that the pin shaft 54 has a textured or roughened surface and this enhances its ability to effectively be captured by the balls in the clutch 36.

The support head 52 has a lower surface 60 which generally overlies the flat top 42. The pin shaft 54 passes through the hole 44 into the chamber 26. In the chamber 26, the pin shaft 54 will be received by the clutch 36 located in the cup 34. Biasing means (not shown) urge the balls to engage the pin shaft 54 and hold it in a fixed or locked position until the balls are moved apart by a magnet (not shown). This is the conventional known operation of the three ball clutch used in control tags.

The support head 52 of the pin assembly 50 is fixed to the top shell cap 16. The support head 52 has an upper surface 64 which has configured therein a recess 70 which holds either ink or an ink filled capsule. The top surface 64 of the support head 52 can be accessed through the opening 18, which itself can be opened and sealed by the reservoir protection cap 20, as described above.

A reservoir plug 68 is provided to seal the ink reservoir formed by the recess 70.

The control is multiple alarm system for keeping track of inventory and preventing the theft thereof. Unauthorized tampering of an article and attempts to remove the control tag 10 from an article will provide alerts to store personnel.

The upper half shell assembly 12 with the attached pin assembly 50 and pin shaft 54 is, in use, pushed through the retail article or product such as an item of clothing, linen or the like. The point 56 and the pin shaft 54 pass through the hole 44 where it will be firmly gripped and held in place by the 3-ball clutch 36 mechanism structure as described above, at the same time sandwiching the product between the upper half shell assembly 12 and the lower half shell assembly 14 so that the product can only be removed by appropriate methods, such as the use of a specially designed magnet to pry apart the balls, as has been described. The proper mechanism for extracting of the upper half shell assembly 12 from the lower half shell assembly 14 without triggering alarms requires that the control tag alarming ink tag be placed on a super lock or sufficiently powerful magnetic detacher. The magnetic detacher will cause the 3 balls to move away from each other under the strong magnetic force to thereby release tension on the pin shaft 54, allowing the upper half shell assembly 12 to be extracted from the pin hole 44 of the lower half shell assembly 14 easily and without fracturing the ink reservoir to effectively ruin the article.

If any attempt is made at pulling the upper and lower halves apart by force, or prying the two halves apart, the pin shaft 54 will break away from the ink reservoir fracturing the ink chamber, and allowing ink to flow out beneath the top shell case, permanently staining the article. The control tag 10 is designed so as to have sufficient strength to withstand normal operating forces and not fracture under such conditions. However, when the force due to tampering exceeds this threshold value, the ink reservoir will fracture and discharge ink over the product rendering it useless for the person attempting to steal the product but also identifiable for store personnel as the target of a theft.

If the control tag is not removed from the product and there is no fracturing of the ink reservoir, the ferrite or other material contained in the chamber 26 will be energized by the electronic surveillance system located usually at the door or exit of the store and the sound alarm will be triggered.

The control tag 10 of the invention thus has a double alarm system, the one backing up the other so that if one is not activated during the course of an attempted theft, the other will be. The control tag of the invention thus addresses in a single device both the ability to trigger an electronic surveillance system at the door or exit of a store and also foil any efforts by a person to defeat the electronic surveillance system by ensuring that any effort to remove the tag will fracture the ink reservoir and thus deposit a large ink stain on the product to make the article essentially worthless. The article of the invention is thus very useful and addresses a void in the control of inventory and the theft of articles from a store. It should also be noted that even if a theft occurs and the thief manages to remove the tagged article from the store, the control tag is constructed to make its removal without the necessary tools very difficult and any subsequent efforts to remove the control tag with ruin the product. This fact in itself may act as a deterrence to the theft in the first place, adding to its value.

The invention is not limited to the precise details described herein. The essence of one aspect of the invention is the provision of a control tag which has built into it both an electronic trigger system to activate a sensor and alarm and thereby thwart its removal from a location, as well as a reservoir for a substance such as an ink or dye of some description which would color the article, either at the location or after it has been removed from the location, to which it is attached, preferably permanently, to thereby ruin the article for the purpose for which it was made.

In view of the above, the control tag of the invention will have a receptacle of any convenient shape or size which includes at least one chamber or space which accommodates both the electronics for activating an external sensor and alarm as well as a frangible reservoir for an ink or dye. The control tag will have two components which clamp together in some fashion at the same time holding the article or inventory there between in a fixed manner which is difficult to disconnect without specially designed tools such as a magnetic detacher. The shape of the control tag can be configured to selected dimensions so as to be somewhat flat, square, circular or other format so suit the application or context in which it will be used.

The control may have desired form of electronics, many of which are in use with conventional tags.

The reservoir may be constructed as part of the control tag itself, or it may be an add-in, and comprise a frangible container for the ink or dye which is received within a recess or space in the control tag specially designed therefor. The reservoir may be located and operate so that when it breaks as a result of unauthorized tampering, the ink or dye not only floods the article, but also contacts the fingers or hand of the person who is tampering with the product so as to identify that person as one who has tried to remove a control tag. Where the control tag uses frangible containers, these may be removable so that they can be replaced without the need to discard the entire control tag if the containers become weakened. Different color inks and dyes may be used for, as an example, inventory control and department identification.

Preferably, the two components of the control tag are fastened together using a pin mechanism on one of the components which is received in a slot three ball clutch arrangement as generally described above. However, it should be appreciated that any suitable form of connection may be used that will satisfy the requirements of the control tag and keep the components fastened to each other on a manner which will defeat all but the more sophisticated attempts to pry them apart.

The invention claimed is:

1. A dual function inventory control tag comprising:

a first component including a dome shaped portion;

a second component including a dome shaped portion;

a fastening mechanism for fastening together the first component and the second component, the fastening mechanism being configured whereby the first component and the second component can be easily locked together and can only be unlocked from each other in normal usage by an external tool;

first and second chambers defined by the first and second components;

an electronic device located in the first chamber for triggering a compatible sensor and alarm system external to the control tag; and a dye container located in the second chamber designed to fracture and spill dye when the first and second components are forced apart, the dye container forming a part of the fastening mechanism.

2. A control tag as claimed in claim 1 wherein the fastening mechanism comprises a pin assembly formed on the first component, the pin assembly having a support head and a pin shaft.

3. A control tag as claimed in claim 2 wherein the fastening mechanism further comprises a clutch mechanism formed on the second component, the clutch mechanism being configured to receive the pin shaft of the pin assembly when the first and second components are fastened together.

4. A control tag as claimed in claim 3 wherein the clutch mechanism comprises a three ball clutch which is located in a cup shaped member of the second component.

5. A control tag as claimed in claim 2 wherein dye container is formed in the support head of the pin assembly.

6. A control tag as claimed in claim 5 wherein the dye container is formed as recess in the support head of the pin assembly.

7. A control tag as claimed in claim 6 wherein the recess in the support head comprises a reservoir plug in an aperture in the recess which fractures or is compromised when the first and second components are forced apart to discharge the dye from the recess.

8. A control tag as claimed in claim 5 wherein the dye container comprises at least one frangible receptacle located in the chamber of the first component, the frangible component fracturing in response to forcing the first and second components apart from each other.

9. A control tag as claimed in claim 1 wherein electronic device is located in the chamber of the second component.

10. A control tag as claimed in claim 1 wherein the first component has an access cap for providing access to the chamber in the first component.

11. A control tag as claimed in claim 1 wherein the first and second component form a generally flattened control tag when fastened together by the fastening mechanism.

12. A control tag as claimed in claim 1 wherein the first and second component form a generally circular control tag when fastened together by the fastening mechanism.

13. A control tag as claimed in claim 1 wherein the first and second component form a generally oval control tag when fastened together by the fastening mechanism.

14. A control tag as claimed in claim 1 wherein the dye container contains ink.

15. A control tag as claimed in claim 14 wherein dye container comprises at least two ink containers.

16. A method for controlling inventory comprising the steps of:

providing a first control tag component;

providing a second control tag component;

fastening together the first control tag component and the second control tag component whereby the first control tag component and the second control tag component can be easily locked together and can only be unlocked from each other in normal usage by an external tool;

forming a first and second chamber in the first and second control tag components;

inserting an electronic device in the first chamber for triggering a compatible sensor and alarm system external to the control tag; and inserting a dye container in the second chamber, the dye container being designed to fracture and spill dye when the first and second control tag components are forced apart from each other, the dye container forming a part of the fastening mechanism.

17. A method as claimed in claim 16 wherein the first control tag component is fastened to the second control tag component by a pin and clutch mechanism.

18. A method as claimed in claim 16 wherein the dye container is inserted in the chamber of the first control tag component and the electronic device is inserted in the chamber of the second control tag component.

19. A method as claimed in claim 16 wherein the first and second control tag components are shaped so as to have a desired external configuration suitable for attachment to a selected product.

20. A method for making a dual function control tag for controlling inventory, the method comprising the steps of:

providing a first control tag component;

providing a second control tag component;

fastening together the first control tag component and the second control tag component whereby the first control tag component and the second control tag component can be easily locked together and can only be unlocked from each other in normal usage by an external tool;

forming at least one chamber in at least one of the first and second control tag components;

inserting an electronic device in one of the chambers for triggering a compatible sensor and alarm system external to the control tag; and inserting a dye container in one of the chambers, the dye container being designed to fracture and spill dye when the first and second control tag components are forced apart from each other.

* * * * *